United States Patent [19]

Kageyama et al.

[11] Patent Number: 4,996,857

[45] Date of Patent: Mar. 5, 1991

[54] METHOD AND AN APPARATUS FOR MANUFACTURING A METALLIC BELLOWS

[75] Inventors: Kenichi Kageyama; Kazuo Ohkoshi; Tsutomu Furuyama, all of Yokohama, Japan

[73] Assignee: NHK Spring Co., Ltd., Yokohama, Japan

[21] Appl. No.: 510,595

[22] Filed: Apr. 18, 1990

[30] Foreign Application Priority Data

Apr. 27, 1989 [JP] Japan ..... 1-108789

[51] Int. Cl.[5] ..... B21D 9/14

[52] U.S. Cl. ..... 72/10; 72/20; 72/59

[58] Field of Search ..... 72/57, 59, 60, 61, 62, 72/10, 20

[56] References Cited

U.S. PATENT DOCUMENTS

| | | | |
|---|---|---|---|
| 2,773,538 | 12/1956 | DeMers | 72/59 |
| 2,954,064 | 9/1960 | DeMers | 72/59 |
| 3,015,354 | 1/1962 | Wood | 72/59 |
| 3,105,539 | 10/1963 | Johnson | 72/59 |
| 3,130,771 | 4/1964 | Peyton | 72/59 |
| 4,751,836 | 6/1988 | Breese | 72/62 |

FOREIGN PATENT DOCUMENTS

| | | | |
|---|---|---|---|
| 2163838 | 6/1973 | Fed. Rep. of Germany | 72/59 |
| 0871894 | 10/1981 | U.S.S.R. | 72/59 |
| 0912337 | 3/1982 | U.S.S.R. | 72/59 |

*Primary Examiner*—David Jones

*Attorney, Agent, or Firm*—Frishauf, Holtz, Goodman & Woodward

[57] ABSTRACT

A first insert member and a head member are inserted in a cylindrical metal material. A liquid pressure chamber is defined in the material by the first insert member and the head member. First and second dies are situated corresponding to the head member and the first insert member, respectively. When a pressurized liquid is fed into the liquid pressure chamber, that portion of the material situated between the first and second dies bulges outward. As the first and second dies are driven to approach each other with the bulging portion between them, a pleat with a U-shaped section is formed.

11 Claims, 9 Drawing Sheets

METHOD AND AN APPARATUS FOR MANUFACTURING A METALLIC BELLOWS

BACKGROUND OF THE INVENTION

1. Field of the Invention

The present invention relates to a method and an apparatus for manufacturing a metallic bellows contained in, for example, an accumulator.

2. Description of the Related Art

Some of apparatuses whose housing contains a liquid and a compressed gas, such as accumulators, may use a metallic bellows for dividing the liquid and the gas. Conventionally, there have been proposed forming apparatuses for manufacturing bellows of this type. In one such conventional apparatus, split dies as many as pleats of the bellows to be formed are arranged between a stationary-side holder and a movable-side holder. These dies and the movable-side holder are movable along guide means. Return springs are disposed compressed between each two adjacent dies so that the dies can be held in position by the elastic force of the springs. The movable-side holder can be moved toward the stationary-side holder by drive means such as a hydraulic cylinder.

In manufacturing a bellows by means of this conventional apparatus, those portions of a cylindrical metal material which are supposed to be formed into pleats of the bellows are bulged outward by applying a bulging liquid pressure to the inside of the metal material. By operating the drive means in this state, the moveable-side holder and the dies are moved toward the stationary-side holder while maintaining a fixed liquid pressure. By doing this, the portions for the pleats of the bellows are plastically deformed to be U-shaped at a stroke. Thus, the bellows of a pre-determined shape can be obtained.

The conventional apparatus described above requires use of the dies as many as the pleats of the bellows and a large number of return springs. Besides, all the dies must slide smoothly along the guide means, so that the proximal portion of each die to engage the guide means must be made somewhat thick. If the dies are too thin, moreover, an excessive surface pressure acts on the engaging portions between the dies and the quide means when the bulging liquid pressure is applied. Naturally, therefore, the dies cannot be unlimitedly thinned, and spaces to house the return springs must be secured between the dies. Furthermore, it is difficult to regulate the pitches between the dies accurately.

For these reasons, the distance between the dies cannot be shortened without substantial restrictions, so that it is difficult to manufacture bellows with short pleat-to-pleat pitches. Since the conventional dies can be used to manufacture bellows of one specific type only, moreover, additional dies must be used to manufacture bellows with different pleat-to-pleat pitches or outside diameters, thus entailing very high manufacturing costs.

SUMMARY OF THE INVENTION

Accordingly, the object of the present invention is to provide a method and an apparatus for manufacturing a metallic bellows, whereby bellows of a predetermined shape can be formed with high accuracy by means of a relatively small number of dies, even short-pitch bellows can be manufactured without difficulties, and bellows with different pleat-to-pleat pitches or outside diameters can be manufactured with use of the same dies.

An apparatus according to the present invention developed in order to achieve the above object is designed to manufacture a bellows from a cylinderical metal material having an open end. The apparatus of the invention comprises: a base having chuck means for fixing the material; a first insert member adapted to be inserted from the open end of the mateiral into a predetermined position in the material; a second insert member passed through the first insert member and having its distal end projecting outward from the distal end of the first insert member; a head member attached to the distal end portion of the second insert member and adapted to be inserted into the material; sealing means for creating a liquid pressure chamber of a predetermined length in the material, the sealing means including a first sealing member interposed between the inner surface of the material and the first insert member and a second seam member interposed between the inner surface of the material and the head member, the first and second insert members covering the whole circumference of the material; a first die and a second die located outside that portion of the material at which the liquid pressure chamber is defined and spaced at a distance long enough to allow at least one pleat to be formed; bulging pressure supply means for supplying a bulging liquid pressure to the liquid pressure chamber, thereby causing that portion of the material situated between the pair of dies to bulge outward; die drive means for relatively moving the pair of dies toward each other, thereby plastically deforming the bulging portion of the material between the dies so that the bulging portion has a U-shaped section, whereby a pleat is formed; and material feeding means for moving the material with the pleats thereon for a distance long enough to allow another pleat to be formed, with respect to the first die.

The sealed liquid pressure chamber is defined inside the material by the sealing means, and is filled with a liquid. The first and second dies are located in predetermined positions around the material in a die positioning process. When the bulging liquid pressure is supplied to the liquid pressure chamber, the region between the dies bulges outward. As the paired dies are relatively driven to approach each other, the region to form a pleat of the bellows is plastically deformed to be U-shaped. After one or more pleats are formed in this manner, the material is moved for a distance long enough to allow another pleat to be formed in a material feeding process. When this material feeding process is finished, the liquid pressure chamber in the material is hermetically sealed again by the sealing means. Then, the bulging liquid pressure is supplied again to the liquid pressure chamber, and the first and second dies are driven relatively to approach each other, thereby forming the new pleat.

By repeating a series of processes from the die positioning process to the material feeding process for the frequency corresponding to the number of pleats to be formed, a bellows with a given number of pleats can be manufactured.

According to the present invention, a bellows with a large number of pleats can be formed with high accuracy by using a relatively small number of dies, and bellows with shorter pleat-to-pleat pitches can be formed. Moreover, various bellows whose pleats vary in outside diameter or pitch in the middle along the axis of the material can be manufactured with use of common dies.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodments given below, serve to explain the principles of the invention.

DETAILED DESCRIPTION OF THE PREFERRED EMBODIMENT

Figure 1:
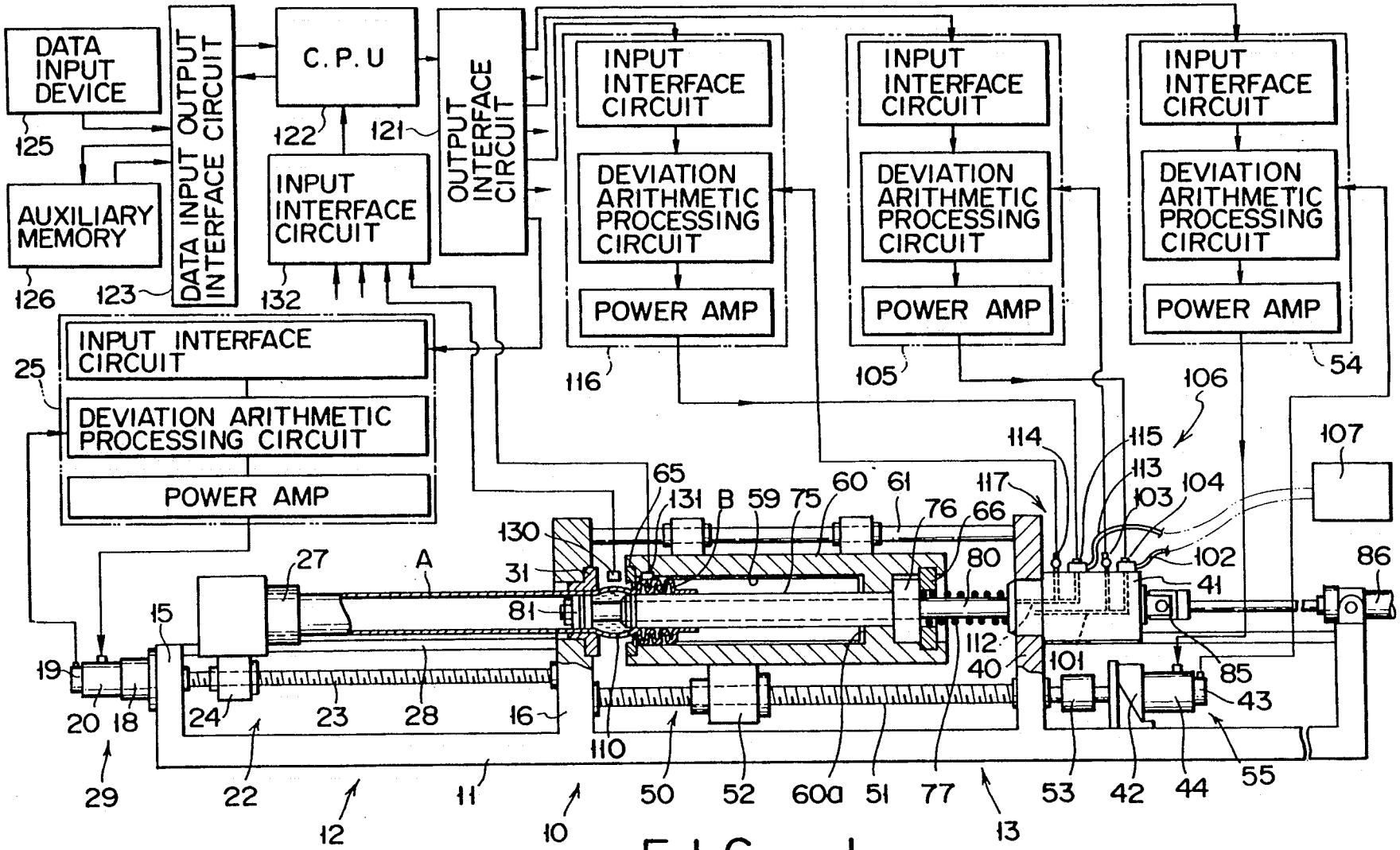
FIG. 1 is a side view, partially in section, showing a bellows manufacturing apparatus according to an embodiment of the present invention.

An embodiment of the present invention will now be described with reference to the accompanying drawings of FIGS. 1 to 7. Bellows manufacturing apparatus 10 shown in FIG. 1 is an apparatus forms a plurality of pleats B by using straight cylindrical metal material A as a material of a bellows. Material A may be of any kind and thickness. Both ends of material A are open.

Apparatus 10 of this embodiment comprises base 11 which has an axis extending in the horizontal direction of FIG. 1. Material supply stage 12 and bellows forming stage 13 are located on the left- and right-hand halves, respectively, of base 11.

Material supply stage 12 is provided with motor mounting section 15 and die mounting section 16. Motor mounting section 15 is fitted with servomotor 20 which is provided with speed reducer 18 and rotational position detector 19. Servomotor 20 may be either AC or DC motor. Ball screw mechanism 22 is disposed between mounting portions 15 and 16. Mechanism 22 includes rotatable lead screw 23, extending in the horizontal direction of FIG. 1 or in the axial direction of base 11, and movable body 24 threadedly engaged with screw 23. When lead screw 23 is rotated by means of servomotor 20, movable body 24 moves in the axial direction of screw 23, corresponding to the amount of rotation of the screw. Detector 19, which resembles a conventional rotary encoder, produces a number of pulses associated with the amount of rotation of motor 20 or lead screw 23, and feeds them back to servo drive circuit 25.

Movable body 24 is provided with chuck mechanism 27, which is used to fix the proximal portion of material A. Mechanism 27 is movable together with movable body 24 in the horizontal direction of FIG. 1, along guide 28 which extends parallel to lead screw 23. Motor 20, ball screw mechanism 22, driver circuit 25, etc. constitute material feeding means 29 for feeding material A. Alternatively, material A may be fed in the aforesaid direction by using any other suitable servo means than servomotor 20 and ball screw mechanism 22.

First die 31 is mounted on die mounting section Material insertion hold 32 (FIG. 2), which has a diameter substantially equal to the outside diameter of material A, is bored through the central portion of die 31. Inner peripheral edge 33 of the inlet side of hole 32 is tapered to facilitate the insertion of material A. The insertion of material A can be made easier if die 31 is a split die which can be divided in two in the diametrical direction of the material.

Liquid pressure supply block 41 is attached to support portion 40 which is mounted on bellows forming stage 13. Block 41 is pressed against support portion 40 by means of drive mechanism 86 mentioned later. Servomotor 44, which has speed reducer 42 and rotational position detector 43, is disposed in the vicinity of support portion 40. Servomotor 44 may be either AC or DC motor. Ball screw mechanism 50 is disposed between support portion 40 and die mounting portion 16. Mechanism 50 includes rotatable lead screw 51, extending in the axial direction of base 11, and movable body 52 threadedly engaged with screw 51. Screw 51 is connected to speed reducer 42 of servomoter 44 by means of coupling 53. When lead screw 51 rotates, movable body 52 moves in the axial direction of screw 51, corresponding to the amount of rotation of the screw.

The rotational position of lead screw 51 is detected by means detector 43. Detector 43, which resembles a conventional rotary encoder, produces a number of pulses associated with the amount of rotation of motor 44 or lead screw 51. These pulses are fed back to servo driver circuit 54. Motor 44, ball screw mechanism 50, driver circuit 54, etc. constitute die drive means 55 for moving second die 65 mentioned later. Servomotor 44 and ball screw mechanism 50 may be replaced with any other suitable servo means for the purpose.

Die holder 60 is attached to movable body 52. Workpiece takeout port 59 is formed in the flank of holder 60. Die holder 60 is movable together with movable body 52 in the axial direction of base 11, along guide 61 which extends parallel to lead screw 51.

Figure 3:
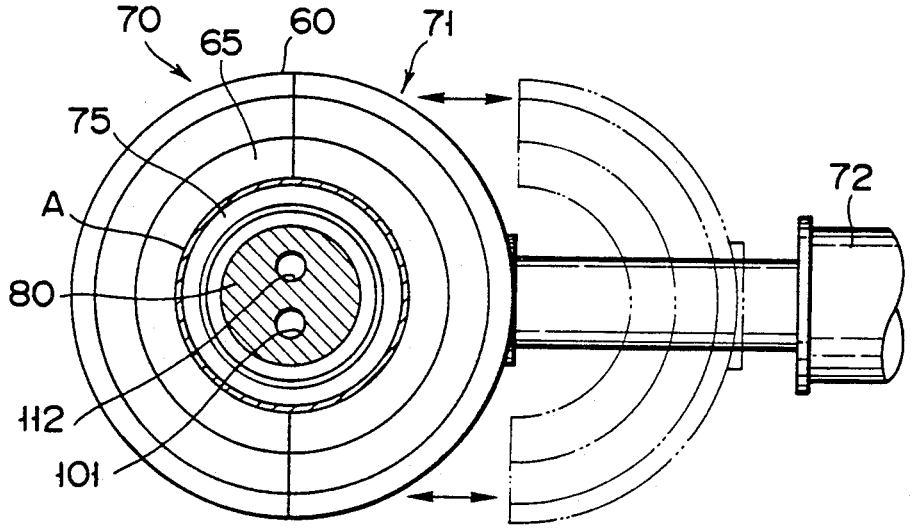
FIG. 3 is a sectional view taken along line III—III of FIG. 2.

Second die 65 is located on the left end side of die holder 60, that is, on the side facing first die 31. Back stopper 66 is provided on the other end side of holder 60. Material insertion hold 67, which has a diameter a little greater than the outside diamter of material A, is bored through the central portion of die 65. Second die 65 and back stopper 66 can be each divided in two in the diametrical direction. As shown in FIG. 3, die holder 60 and die 65 are formed of a pair of elements 70 and 71 which can be divided from each other in the diametrical direction of material A. Elements 70 and 71 can be moved in the diametrical direction of material A by means of drive mechanism 72 which includes a hydraulic cylinder or the like.

Cylindrical first insert member 75, which is adapted to be inserted into die holder 60, is located coaxial with holder 60. Flange portion 76, which is formed on the rear end of insert member 75, is restrained from moving in its axial direction by back stopper 66. Thus, first insert member 75 can move together with die holder 60 in the axial direction of guide 61. Compression spring 77 is interposed between flange portion 76 and liquid pressure supply block 41.

Figure 2:
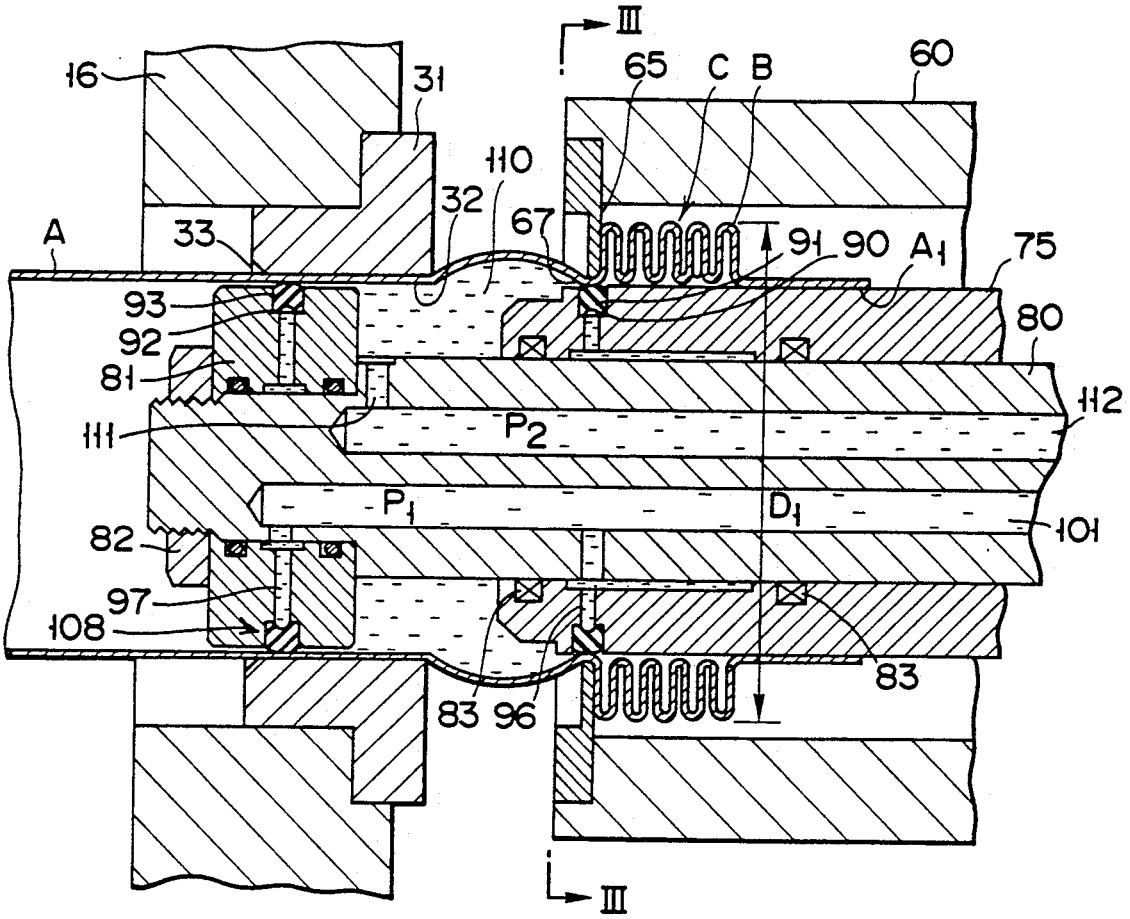
FIG. 2 is an enlarged sectional view showing part of the apparatus shown in FIG. 1.

Second insert member 80 is inserted in first insert member 75 so as to be movable in the axial direction of first member 75. Piston-shaped head member 81 is fixed to the left end side of second insert member 80 by means of nut 82. As shown in FIG. 2, the region between first and second insert members 75 and 80 is sealed by means of sealing member 83. The other end side of second insert member 80 is integrally attached to liquid pressure supply block 41 in a manner such that a liquid is prevented from leaking into block 41. Block 41 is connected to drive mechanism 86, such as a hydraulic or pneumatic cylinder, by means of coupling 85. Second insert member 80 can be moved in the axial direction of first insert member 75, with respect to die holder 60, by means of drive mechanism 86.

As shown in FIG. 2, first annular groove 90 is formed at the outer peripheral portion of an end of first insert member 75, corresponding in position to second die 65. Groove 90 extends along the circumference of first insert member 75. First sealing member 91 is fitted in first annular groove 90. Second annular groove 92 is formed on the outer peripheral surface of head member 81, corresponding in position to first die 31. Second sealing member 93 is fitted in second annular groove 92. Sealing members 91 and 93 are formed of rubberlike elastic material, such as urethane elastomer.

First insert member 75 and head member 81 have radial holes 96 and 97, respectively, which connect with the inner peripheral surfaces of sealing members 91 and 93, respectively. Holes 96 and 97 communicate with sealing pressure supply liquid passage 101 which extends along the axial direction of second insert member 80. Passage 101 is connected to sealing pressure supply hose 102, pressure changer 103, hydraulic servo valve 104, etc. by means of liquid pressure supply block 41. Hose 102 is connected to liquid pressure producing unit 107. A pressure detection signal delivered from pressure changer 103 is fed back to servo valve driver circuit 105. Liquid passage 101, hose 102, servo valve 104, driver circuit 105, etc. constitute sealing pressure supply means 106. First and second sealing members 91 and 93 constitute sealing means 108.

Inside material A, liquid pressure chamber 110 is defined between first and second sealing members 91 and 93 by the inner surface of the material, first and second insert members 75 and 80, and head member 81. Chamber 110 communicate with bulging pressure supply liquid passage 112 by means of hold 111 in second insert member 80. Passage 112, like sealing pressure supply liquid passage 101, extends along the axial direction of second insert member 80. Passage 112 is connected to bulging pressure supply hose 113, pressure changer 114, hydraulic servo valve 115, etc. by means of liquid pressure supply block 41. A pressure detection signal delivered from pressure changer 114 is fed back to servo valve driver circuit 116. Liquid passage 112, hose 113, servo valve 115, driver circuit 116, etc. constitute bulging pressure supply means 117.

Driver circuits 25, 54, 105 and 116 are connected too central processing unit (CPU) 122 by means of output interface circuit 121. Data input device 125 and auxiliary memory 126 are coonnected to CPU 122 by means of interface circuit 123.

As shown in FIG. 1, first and second sensors 130 and 131 are located beside dies 31 and 65, respectively, Sensors 130 and 131 are used to detect the bulge diameter of material A during bulging work and pitch $\Delta P$ (see FIG. 7) between formed pleats, respectively. Sensors 130 and 131, which may be of any type, may be each formed of a line-image sensor using a CCD (charge-coupled device), for example, Output signals from sensors 130 and 131 are applied too CPU 122 through input interface circuit 132.

The following is a description of the apparatus of the embodiment constructed in this manner.

Figure 4:
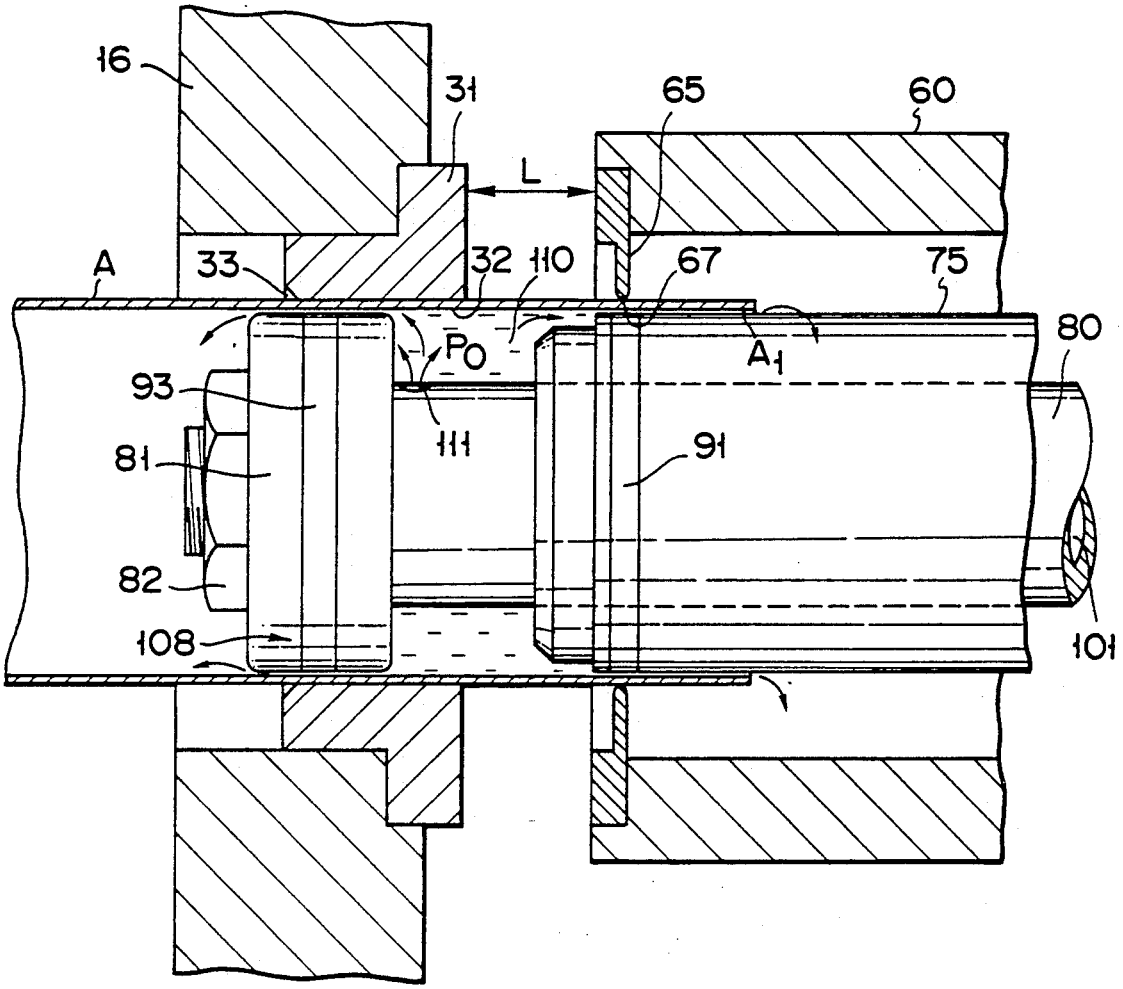
FIG. 4 is a partial sectional view of the apparatus of FIG. 1 showing the state before a bellows is formed.

In material supply stage 12, the trailing end portion of material A is bound by means of chuck mechanism 27 which is previously retreated to the left of FIG. 1. In response to a command based on data previously entered in CPU 122, servomotor 20 rotates for a predetermined amount. As lead screw 23 is rotated for the predetermined amount, open end Al'of material A passes through holes 32 and 67 of dies 31 and 65, and reaches and stops at a predetermined axial position relative to first insert member 75, as shown in FIG. 4. In this state, sealing members 91 and 93 are situated inside material A. In this sealing member insertion process, material A can be easily passed through hole 32 if second die 65 is divided in the diametrical direction, as indicated by two-dot chain line in FIG. 3. After material A is passed in this manner, die 65 is closed. Since die holder 60 and first insert member 75 are held in predetermined relative positions by means of back stopper 66, the respective positions of second die 65 and sealing member 91 accurately corresponding to each other. Sealing member 93 on head member 81 is situated inside first die 31. Distance L between dies 31 and 65 is just long enough to allow one pleat of the bellows to be formed. Distance L is regulated as die holder 60 moves to its predetermined initial position when servomotor 44 is driven to rotate in response to a command from CPU 122. In this die positioning process, dies 31 and 65 are located in their respective predetermined positions.

In a process for feeding material A to die 31, no pressure is applied to sealing pressure supply liquid passage 101. Accordingly, sealing members 91 and 93 are not pressed against the inner surface of material A. Liquid pressure chamber 110, which is defined inside material A, is filled with oil as an example of the liquid. When servo valve 115 is opened in response to a command from CPU 122, the oil at low pressure PO which cannot deform material A is supplied to liquid pressure chamber 110 through bulging pressure supply hose 113 and hole 111. The oil supplied to liquid pressure chamber 110 removes residual air in chamber 110 as the surplus oil flows out through narrow gaps between the inner surface of material A and sealing members 91 and 93, as indicated by arrows in FIG. 4. Thus, liquid pressure chamber 110 is filled up with the oil.

Then, the other servo valve 104 opens in response to a command form CPU 122, whereupon the oil at pressure P1 is supplied to the side of the inner peripheral surfaces of sealing members 91 and 93 through sealing pressure supply hose 102 and liquid passage 101. As a result, sealing members 91 and 93 are deformed in a direction such that their diameters increase. Thus, the sealing members come into intimate contact with the inner surface of material A, thereby hermetically sealing liquid pressure chamber 110.

Figure 5:
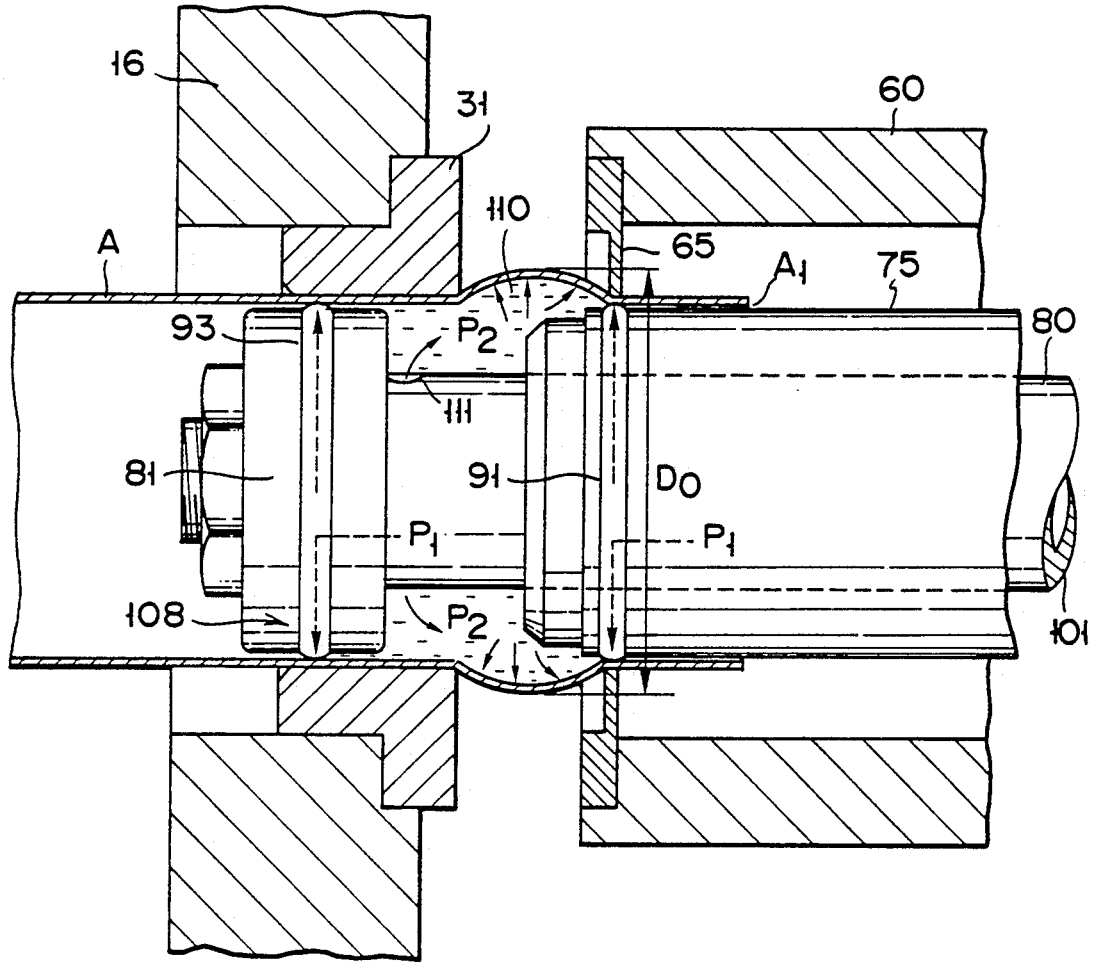
FIG. 5 is a sectional view of the apparatus of FIG. 1 showing a state for bulging.

Subsequently, in response to a command from CPU 122, the oil at pressure P2 is introduced into liquid pressure chamber 110 through servo valve 115, bulging pressure supply hose 113, liquid passage 112. When bulging pressure P2 acts on chamber 110 in this manner, that portion of material A situated between dies 31 and 65 bulges out in a gentle curve, as shown in FIG. 5. This is a bulging process. Outside diameter D0 of material A inflated by the bulging work is detected by means of sensor 130. When bulge diameter D0 attains a predetermined value, the oil supply to liquid pressure chamber 110 is stopped while maintaining fixed pressure P2. Diameter D0 of material A detected by sensor 130 is fed back to CPU 122, and oil pressure P2 is controlled in accordance with the detected value. By doing this, bulge diameter D0 can be restrained from varying when the wall thickness of material A is subject to variation. This regulation is very effective for the improvement of the accuracy of outside diameter D1 of formed pleats B.

Figure 6:
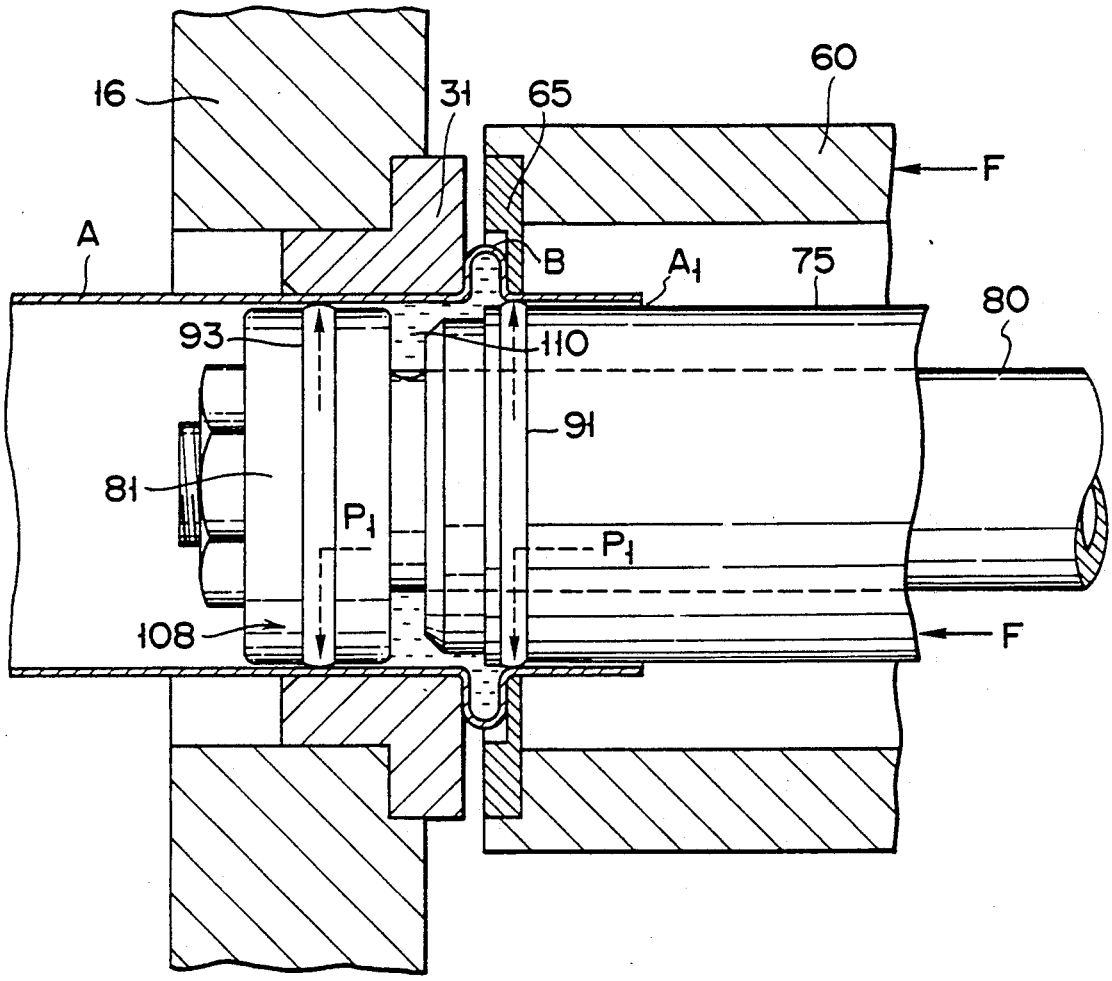
FIG. 6 is a sectional view of the apparatus of FIG. 1 showing a state for pleat forming.

When die holder 60 and first insert member 75 is driven in the direction of arrow F of FIG. 6, second die 65 is moved in the direction to approach first die 31. Second insert member 80 and head member 81 are kept fixed with respect to first die 31. Pressure P2 in liquid pressure chamber 110 is kept constant by means of servo valve 115. Thus, as second die 65 moves toward first die 31 for a predetermined stoke, that portion of material A which bulges between dies 31 and 65, corresponding to one pleat of the bellows, is axially compressed to undergo plastic deformation, that is, to be U-shaped. This is a die drive process. The axial dimension of pleat B is minimized when second die 65 is moved to the predetermined position relative to first die 31.

After first pleat B is formed in the aforesaid series of processes, the pressure in liquid pressure chamber 110 is reduced to zero of a level low enough not to deform material A. At the same time, pressure P1 on sealing members 91 and 93 is reduced to zero or a level lower than P1, whereupon the force of pressure on members 91 and 93 is removed or reduced. Then, second die 65 is divided in the diametrical direction, and is retreated to the position at distance L from first die 31. At the same time, servomotor 20 for material feeding rotates for the predetermined amount in response to the command from CPU 122, whereupon material A is advanced for a distance long enough to form another pleat. During this material feeding process, bulging pressure supply means 117 continues to supply the oil at pressure PO to liquid pressure chamber 110, that is, the oil goes on being fed into chamber 110.

After the material feeding process is finished, second die 65 is closed, as indicated by full line in FIG. 3, in response to a command from CPU 122. When sealing pressure P1 is applied to sealing pressure supply liquid passage 101, sealing members 91 and 93 come into intimate contact with the inner surface of material A. As bulging pressure P2 is applied again to liquid pressure chamber 110, that region of material A situated between dies 31 and 65 bulges out in a gentle curve. When second die 65 is moved toward first die 31, thereafter, second pleat B is formed. Pitch ΔP of pleats B thus formed is detected by means of sensor 131. The detected value is fed back to CPU 122. The feed amount of material A is finely adusted to an optimum value in accordance with the detected value of pitch ΔP. This adjustment is very effective for the improvement of the accuracy of pitch ΔP of pleats B.

Figure 7:
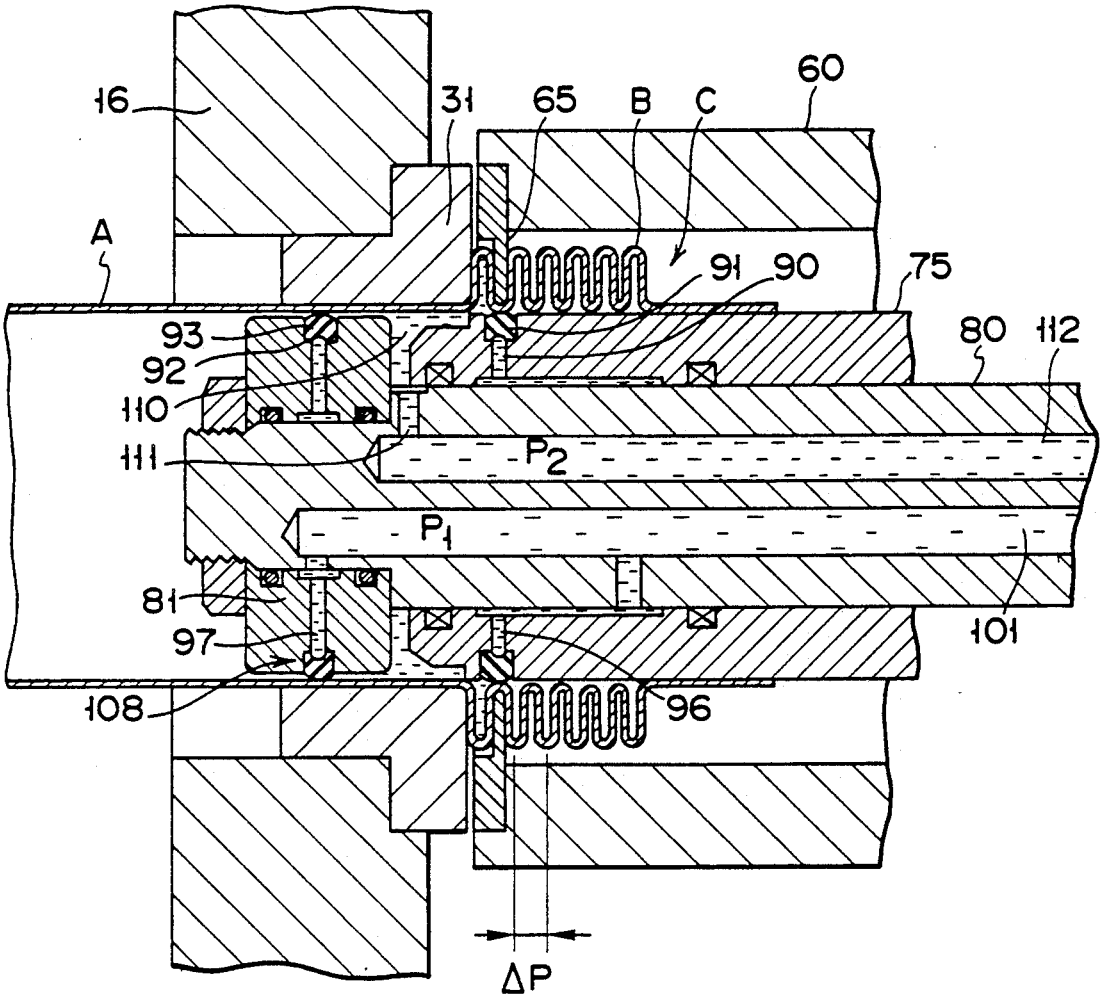
FIG. 7 is a sectional view of the apparatus of FIG. 1 showing a state after pleat forming.
Figure 8:
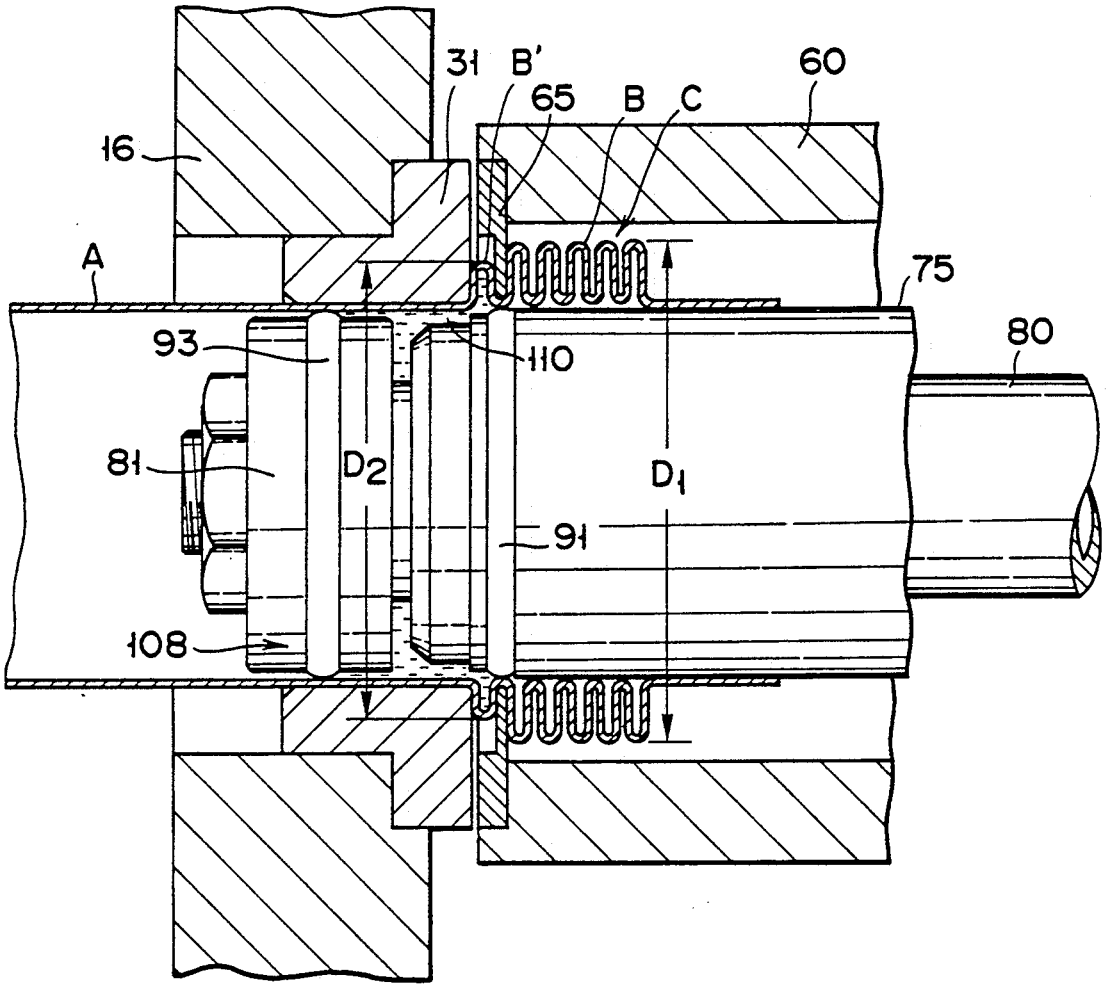
FIG. 8 is a sectional view showing a state after pleats with a short outside diameter are formed by using the apparatus of FIG. 1.

By repeating the series of processes, including the die positioning process, bulging process, die drive process, and material feeding process, a plurality of pleats B are formed one by one and accumulated in succession, as shown in FIG. 7. Pitch ΔP between pleats B can be widened by making the feed amount of material A in the material feeding process greater than in the case of the aforementioned embodiment. Further, outside diameter D2 of pleat B′ can be made shorter than outside diameter D1 of pleats B, as shown in FIG. 8, by making the feed amount of material A in the material feeding process and the movement amount of die 65 in the die drive process smaller than in the case of the embodiment.

When a predetermined number of pleats are formed by repeating the aforementioned processes of operation, chuck mechanism 27 releases its hold of formed bellows C and servomotor 20 rotates in response to commands from CPU 122, whereupon mechanism 27 returns to its initial position on the left end side of FIG. 1. At the same time, die 65, back stopper 66, etc. open in the diametrical direction, and first and second insert members 75 and 80 and liquid pressure supply block 41 are moved fully to the right of FIG. 1 by means of drive mechanism 86. In the meantime, die holder 60 is kept at a standstill. Thus, formed bellows C is left abutting against right-hand end **60*a* inside die holder 60, so that it can be taken out through workpiece takeout port 59**.

Figure 9:
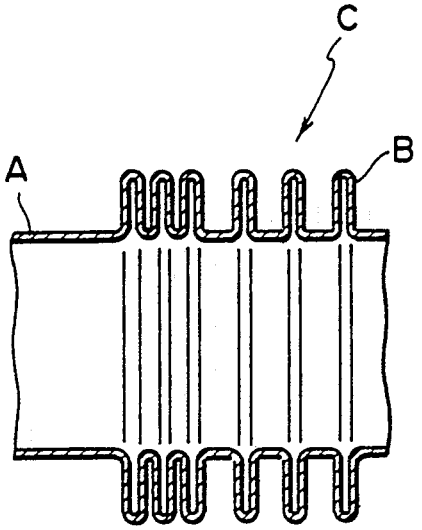
FIGS. 9 to 12 are sectional views individually showing several modifications of the bellows.
Figure 10:
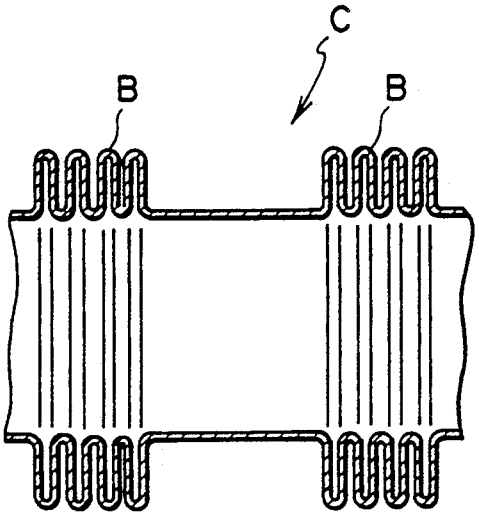
Figure 11:
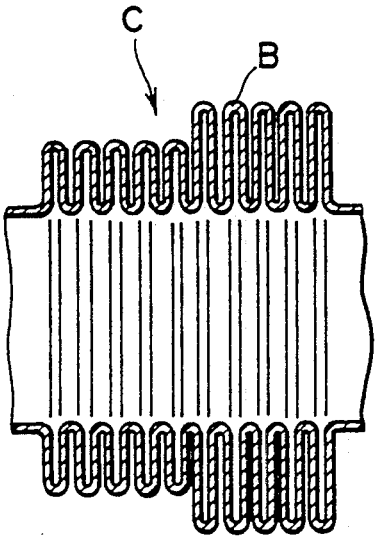
Figure 12:
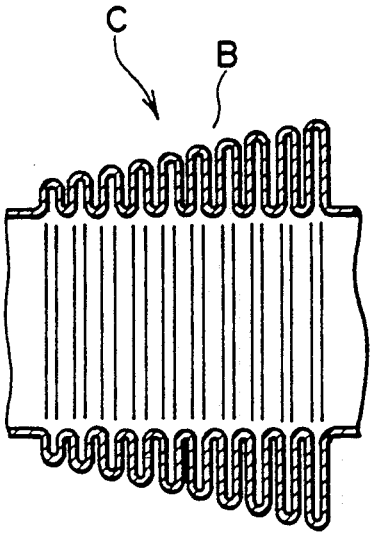

According to apparatus 10 of the present embodiment, the data entered in CPU 122 can be changed as required to produce various bellows C. In bellows C shown in FIG. 9 or 10, for example, the pitch between pleats B varies in the middle along the axis. In bellows C shown in FIG. 11 or 12, the outside diameter of pleats B varies in the middle along the axis. In apparatus 10, moreover, die 65 can be made thin enough to manufacture bellows with fine pitches without difficulties. Since the position of die 65 can be accurately regulated, furthermore, pleats B can be formed with high accuracy. Since even a great number of pleats B are successively formed one by one, moreover, they can continue to be produced as long as material A is supplied. Thus, a long bellows can be formed from a single material A without requiring welding or other connection work.

Figure 13:
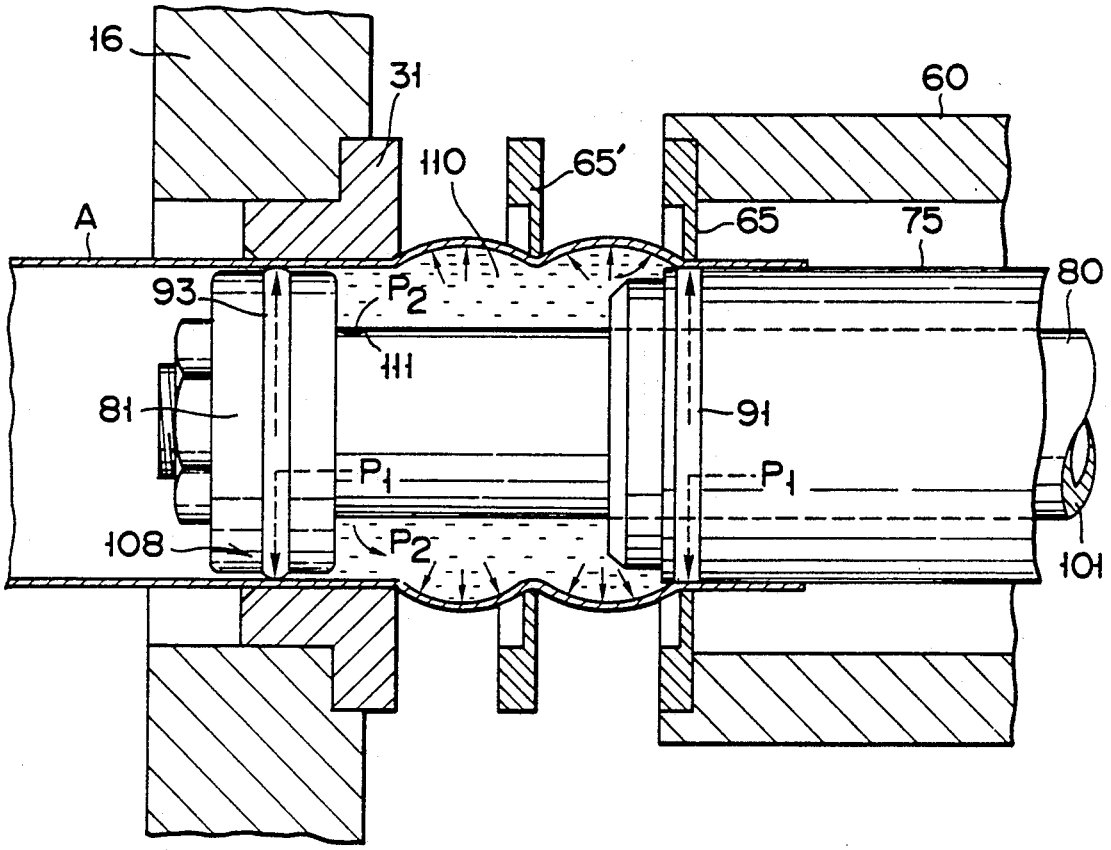
FIG. 13 is a side view, partially in section, showing an alternative embodiment using a third die.

According to the present invention, the pleats may be formed two by two by using third die 65′ provided between first and second dies 31 and 65, as shown in FIG. 13. Third die 65′ has the same shape as second die 65.

According to the present invention, moreover, the liquid introduced into liquid pressure chamber 110 is not limited to oil. For example, sealing pressure P1 and bulging pressure P2 may be produced by using water or some other liquid in place of oil.

Additional advantages and modifications will readily occur to those skilled in the art. Therefore, the invention in its broader aspects is not limited to the specific details, representative devices, and illustrated examples shown and described. Accordingly, various modifications may be made without departing from the spirit or scope of the general inventive concept as defined by the appended claims and their equivalents.

What is claimed is:

1. A method for manufacturing a metallic bellows from a cylindrical metal material, comprising:

(a) inserting sealing means into said cylindrical metal material, to thereby define a sealed liquid pressure chamber with a predetermined length in the axial direction inside said cylindrical metal material;

(b) locating a first die and a second die at a distance therebetween long enough to allow at least one pleat to be formed on that portion of the outer peripheral surface of said cylindrical metal material in which said liquid pressure chamber is defined;

(c) applying a bulging liquid pressure to said liquid pressure chamber from said cylindrical metal material situated between said pair of dies to bulge outwardly throughout the circumference thereof;

(d) moving said pair of dies relatively toward each other, for thereby plastically deforming the bulging portion of said cylindrical metal material so that said bulging portion has a U-shaped section;

(e) advancing or feeding said cylindrical metal material for a predetermined distance in the axial direction thereof, with respect to said first die;

repeating steps (a), (b), (c), (d) and (e) for a number of times corresponding to the number of pleats to be formed in said cylindrical metal material, thereby successively forming the required number of pleats;

detecting, by means of a first sensor, the bulge diameter of said cylindrical metal material, which is bulged outwardly in the step of applying pressure; and controlling the applied bulging liquid pressure in said liquid pressure chamber in acordance with the detected value of bulge diameter detected by said first sensor.

2. The manufacturing method according to claim 1, further comprising:

detecting, by means of a second sensor, the pitch between a pleat formed in step (d) and a previously formed pleat; and controlling the amount of material feed in step (e) in accordance with the detected value of pitch detected by said second sensor, so that the pitch of new pleats formed thereafter has a desired value.

3. The manufacturing method according to claim 1, wherein the feed amount of the material in step (e) is made greater when the pitch between the pleats of the bellows to be formed is increased than when the pitch is reduced.

4. The manufacturing method according to claim 1, wherein the feed amount of the material in step (e) and the relative movement amount of the dies in step (d) are both made greater when the outside diameter of the pleats to be formed is increased than when the outside diameter is reduced.

5. A method for manufacturing a metallic bellows from a cylindrical metal material, comprising:

(a) inserting sealing means into said cylindrical metal material, to thereby define a sealed liquid pressure chamber with a predetermined length in the axial direction inside said cylindrical metal material;

(b) locating a first die and a second die at a distance therebetween long enough to allow at least one pleat to be formed on that portion of the outer peripheral surface of said cylindrical metal material in which said liquid pressure chamber is defined;

(c) applying a bulging liquid pressure to said liquid pressure chamber from said cylindrical metal material situated between said pair of dies to bulge outwardly throughout the circumference thereof;

(d) moving said pair of dies relatively toward each other, for thereby plastically deforming the bulging portion of said cylindrical metal material so that said bulging portion has a U-shaped section;

(e) advancing or feeding said cylindrical metal material for a predetermined distance in the axial direction thereof, with respect to said first die;

repeating steps (a), (b), (c), (d) and (e) for a number of times corresponding to the number of pleats to be formed in said cylindrical metal material, thereby successively forming the required number of pleats;

detecting, by means of a sensor, the pitch between a pleat formed in step (d) and a previously formed pleat; and controlling the amount of material feed in step (e) in accordance with the detected value of pitch detected by said sensor, so that the pitch of new pleats formed thereafter has a desired value.

6. The manufacturing method according to claim 5, wherein the feed amount of the material in step (e) is made greater when the pitch between the pleats of the bellows to be formed is increased than when the pitch is reduced.

7. The manufacturing method according to claim 5, wherein the feed amount of the material in step (e) and the relative movement amount of the dies in step (d) are both made greater when the outside diameter of the pleats to be formed is increased than when the outside diameter is reduced.

8. An apparatus for manufacturing a bellows by forming pleats on a cylindrical metal material having an open end, comprising:

a base having chuck means for fixing the position of said cylindrical metal material;

a first insert member adapted to be inserted from said open end of said cylindrical metal material to a predetermined position in said cylindrical metal material;

a second insert member passing through said first insert member and having a distal end projecting outwardly from a distal end of said first insert member;

a head member attached to a distal end portion of said second insert member and adapted to be inserted into said cylindrical metal material;

sealing means for creating a liquid pressure chamber of a predetermined length in said cylindrical metal material, said sealing means including a first sealing member interposed between an inner surface portion of said cylindrical metal material and said first insert member, and a second sealing member interposed between an inner surface portion of said cylindrical metal material and said head member, said first and second insert members covering the whole circumference of said cylindrical metal material;

a first die and a second die located outside that portion of said cylindrical metal material at which said liquid pressure chamber is defined and spaced at a distance long enough to allow at least one pleat to be formed in said cylindrical metal material;

bulging pressure supply means for supplying a bulging liquid pressure to said liquid pressure chamber, thereby causing that portion of said cylindrical metal material situated between said first and second dies to bulge outwardly;

die drive means for relatively moving said first and second dies toward each other, thereby plastically deforming said outwardly bulging portion of said cylindrical metal material between said dies so that said bulging portion has a generally U-shaped cross section, whereby a pleat is formed;

material feeding means for moving said cylindrical metal material with said pleats thereon for a distance long enough to allow another pleat to be formed therein, with respect to said first die; and a first sensor for detecting the outside diameter of the material bulged by the bulging pressure supply means and a second sensor for detecting the pitch between the formed pleats.

9. The manufacturing apparatus according to claim 8, wherein said second die is divided in a diametrical direction of said cylindrical metal material.

10. The manufacturing apparatus according to claim 8, further comprising:

sealing pressure supply means including a liquid passage connected with respective inner peripheral surfaces of said first and second sealing members; and liquid pressure producing means for applying a liquid pressure to said liquid passage to press respective outer peripheral surfaces of said sealing members against the inner surface of said cylindrical metal material.

11. The manufacturing apparatus according to claim 8, wherein said bulging pressure supply means supplies a liquid at a pressure lower than the bulging liquid pressure to said liquid pressure chamber in a manner such that no liquid pressure is applied to said sealing members by said sealing pressure supply means, thereby keeping said liquid pressure chamber filled with the liquid lest air enter said liquid pressure chamber.

* * * * *